United States Patent [19]

Rericha et al.

[11] Patent Number: 4,811,703

[45] Date of Patent: Mar. 14, 1989

[54] VALVE STEM SEAL

[75] Inventors: Brian F. Rericha, Downers Grove; Bernard G. Stritzke, Hanover Park, both of Ill.

[73] Assignee: Microdot Inc., Darien, Conn.

[21] Appl. No.: 167,736

[22] Filed: Mar. 14, 1988

[51] Int. Cl.[4] ..... F01L 3/08

[52] U.S. Cl. ..... 123/188 P; 277/181

[58] Field of Search ..... 123/188 P, 188 R; 277/181

[56] References Cited

U.S. PATENT DOCUMENTS 3,699,942 10/1972 Moray ..... 123/188 P

*Primary Examiner*—E. Rollins Cross

*Attorney, Agent, or Firm*—Lyman R. Lyon

[57] ABSTRACT

A fixed valve stem oil seal comprises a cup-shaped case engageable with the valve guide of a piston-type internal combustion engine. An "O-ring" type seal element is disposed between radial flanges on the case and the valve guide so as to be radially movable relative thereto. The seal element is slidable engageable with the valve stem, valve guide, and said case so as to effect a seal between the valve and valve guide.

2 Claims, 1 Drawing Sheet

Fig. 1.
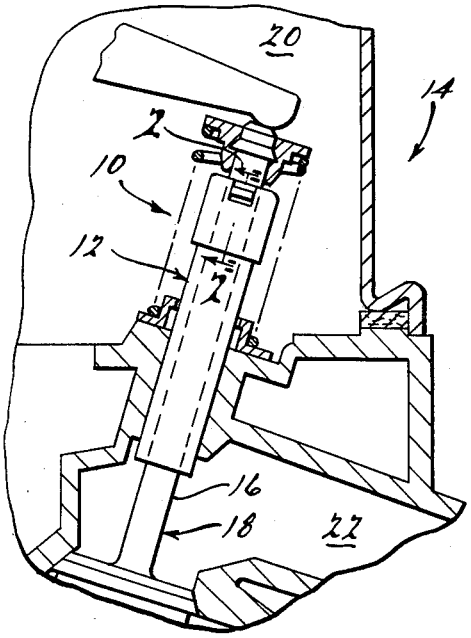
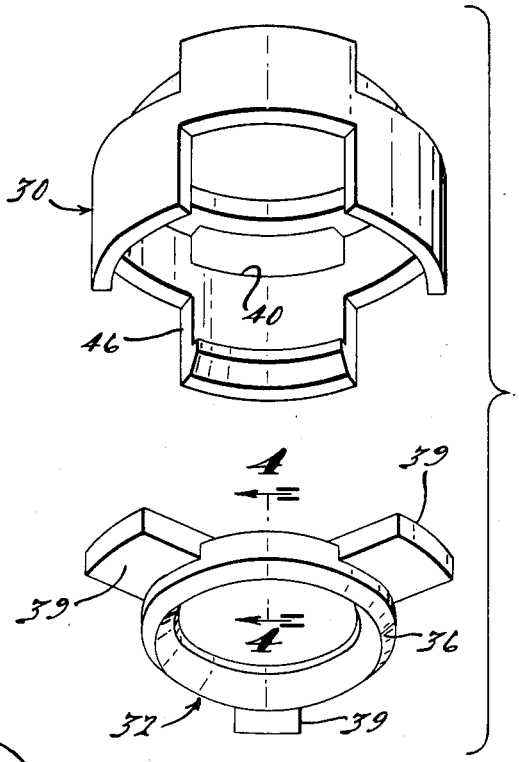
Fig. 3.
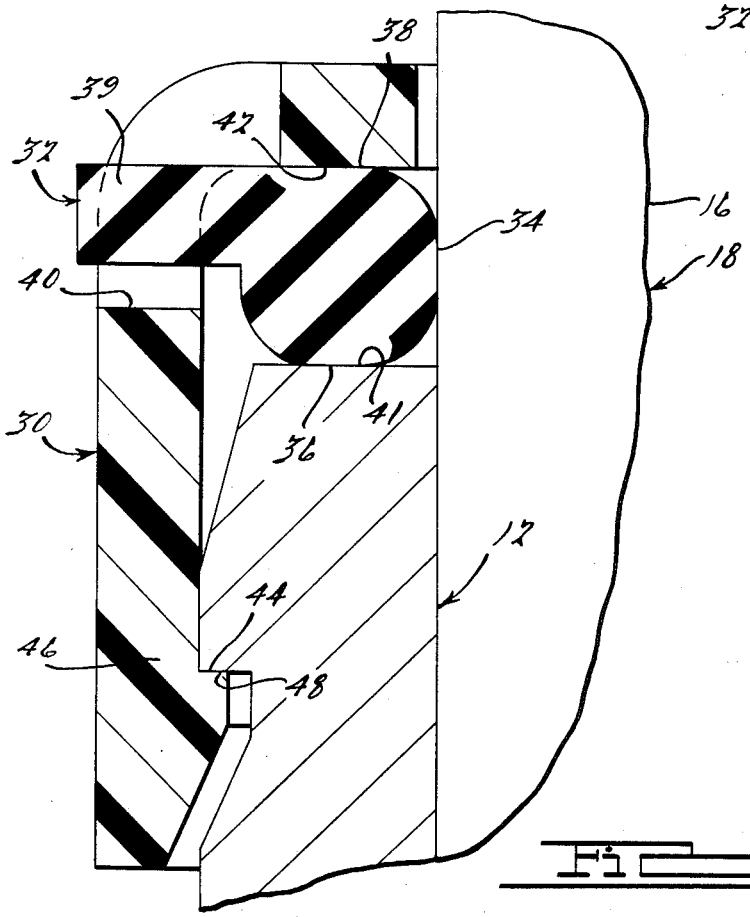
Fig. 2.
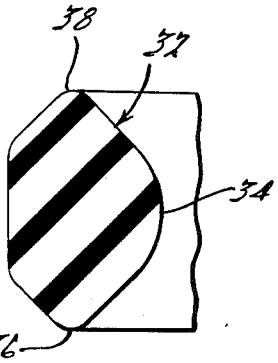
Fig. 4.

VALVE STEM SEAL

BACKGROUND OF THE INVENTION

Valve stem oil deflectors are generally secured to the valve stem so as to reciprocate therewith. However, such known oil deflectors have a basic deficiency in that the valve guide is not completely sealed from the ambient conditions within the valve chamber of the engine.

One solution to the aforesaid problem is a valve stem oil seal that is positively mounted on the valve guide as taught in Application Ser. No. 07/044,709 filed May 1, 1987, now U.S. Pat. No. 4,773,363, for "Fixed Valve Stem Oil Deflector" and assigned to the assignee hereof. However, a problem has arisen in that positive mounting of said valve stem oil seal does not accommodate misalignment between the central axis of the valve stem and the central axis of the valve guide due to manufacturing tolerance error or operating conditions.

SUMMARY OF THE INVENTION

The instant invention relates to a valve stem oil seal that is mounted on the valve guide of an internal combustion engine so as to positively seal the valve stem and valve guide from the environment of the valve chamber yet accommodate misalignment of the central axis of the valve and valve guide. The oil seal comprises a cup-shaped case that supports a laterally movable resilient seal element. The seal element has a radially inwardly facing sealing surface that engages the valve stem and opposite axially facing sealing surfaces that engage a complementary surface on the cup-shaped case and the valve guide, respectively.

More specifically, the fixed valve stem oil seal of the instant invention comprises a cup-shaped case which entraps a radially movable axially comressable "O-ring". Radially outwardly extending flanges on the "O-ring" retain the "O-ring" within the case prior to assembly.

BRIEF DESCRIPTION OF THE DRAWINGS

FIG. 1 is a fragmentary view, partially in section, of a fixed valve stem oil seal in its operating environment.

FIG. 2 is a cross-sectional view taken along the line 2—2 of FIG. 1.

FIG. 3 is an exploded view of the valve stem seal; and

FIG. 4 is a view taken along the line 4—4 of FIG. 3.

DETAILED DESCRIPTION OF THE PREFERRED EMBODIMENT OF THE INVENTION

As seen in FIG. 1, a valve stem oil seal 10, in accordance with a preferred constructed embodiment of the present invention, is mounted on a valve guide 12 of an internal combustion engine 14 so as to positively seal a valve stem 16 of a valve 18 relative to the valve guide 12. The oil seal 10 seals the environment of a valve chamber 20 from a manifold 22 yet accommodates misalignment of the central axis of the valve 18 and valve guide 12.

In accordance with the instant invention, the oil seal 10 comprises a cup-shaped case 30 that supports a laterally movable resilient elastomeric seal element 32. The seal element 32 has a radially inwardly facing sealing surface 34 that engages the valve stem 16 and axially facing sealing surfaces 36 and 38 that engage complementary radially extending surfaces 41 and 42 on the valve guide 12 and case 30, respectively. Radially outwardly extending flanges 39 on the seal 32 extend through complementary apertures 40 in the case 30 to retain the seal 32 in the case 30 prior to assembly about the stem 16 of the valve 18.

The case 30, and therefor the radially inwardly extending surface 42 on the case 30, is positively positioned relative to the surface 41 on the valve guide 12 by latch surfaces 44 on downwardly extending legs 46 of the case 30 which engage complementary surfaces 48 on the valve guide 12. Thus, a positive seal is effected by seal 32 against the case 30, valve guide 12, and valve 18.

While the preferred embodiment of the invention has been disclosed, it should be appreciated that the invention is susceptible of modification without departing from the scope of the following claims.

We claim:

1. A fixed valve stem oil seal for piston-type internal combustion engine comprising a cup-shaped case having a radially extending flange with a central aperture for the acceptance of a valve stem and an axially extending portion positively engageable with a valve guide, and a seal element disposed between the radial flange on said case and said valve guide and radially movable relative thereto, said seal element comprising an elastomeric "O-ring" having a first sealing surface engageable with the valve stem, a second sealing surface engageable with the radial flange on said case and a third sealing surface engageable with an upper radial surface of said valve guide so as to effect a seal between said valve and said valve guide.

2. A valve stem oil seal in accordance with claim 1 wherein the axially extending portion of said case has a plurality of circumferentially spaced apertures and said "O-ring" has a plurality of radially extending flanges complementary to said apertures to retain said "O-ring" in said case.

* * * * *